United States Patent [19]

Wittrock

[11] 3,943,039

[45] Mar. 9, 1976

[54] ANODIZING PRETREATMENT FOR NICKEL PLATING

[75] Inventor: Henry J. Wittrock, Pleasanton, Calif.

[73] Assignee: Kaiser Aluminum & Chemical Corporation, Oakland, Calif.

[22] Filed: Oct. 8, 1974

[21] Appl. No.: 513,197

[52] U.S. Cl. ..... 204/42; 204/58

[51] Int. Cl.[2] ..... C25D 5/44; C25D 11/08

[58] Field of Search ..... 204/42

[56] References Cited

UNITED STATES PATENTS 3,098,804 7/1963 Wittrock ..... 204/41

OTHER PUBLICATIONS

H. J. Wittrock, 48th Annual Tech. Proceedings, Am. Electroplaters' Soc., pp. 52–59, (1961).

*Primary Examiner*—G. L. Kaplan

*Attorney, Agent, or Firm*—Paul E. Calrow; Edward J. Lynch

[57] ABSTRACT

This invention relates to a process of pretreating an aluminum surface for subsequent nickel plating to provide improved adhesion and corrosion resistance. The pretreatment process comprises subjecting the aluminum surface to anodizing in a phosphoric acid electrolyte in such a manner so that the voltage is increased to operating levels within 30 seconds, preferably in less than 15 seconds.

8 Claims, 1 Drawing Figure

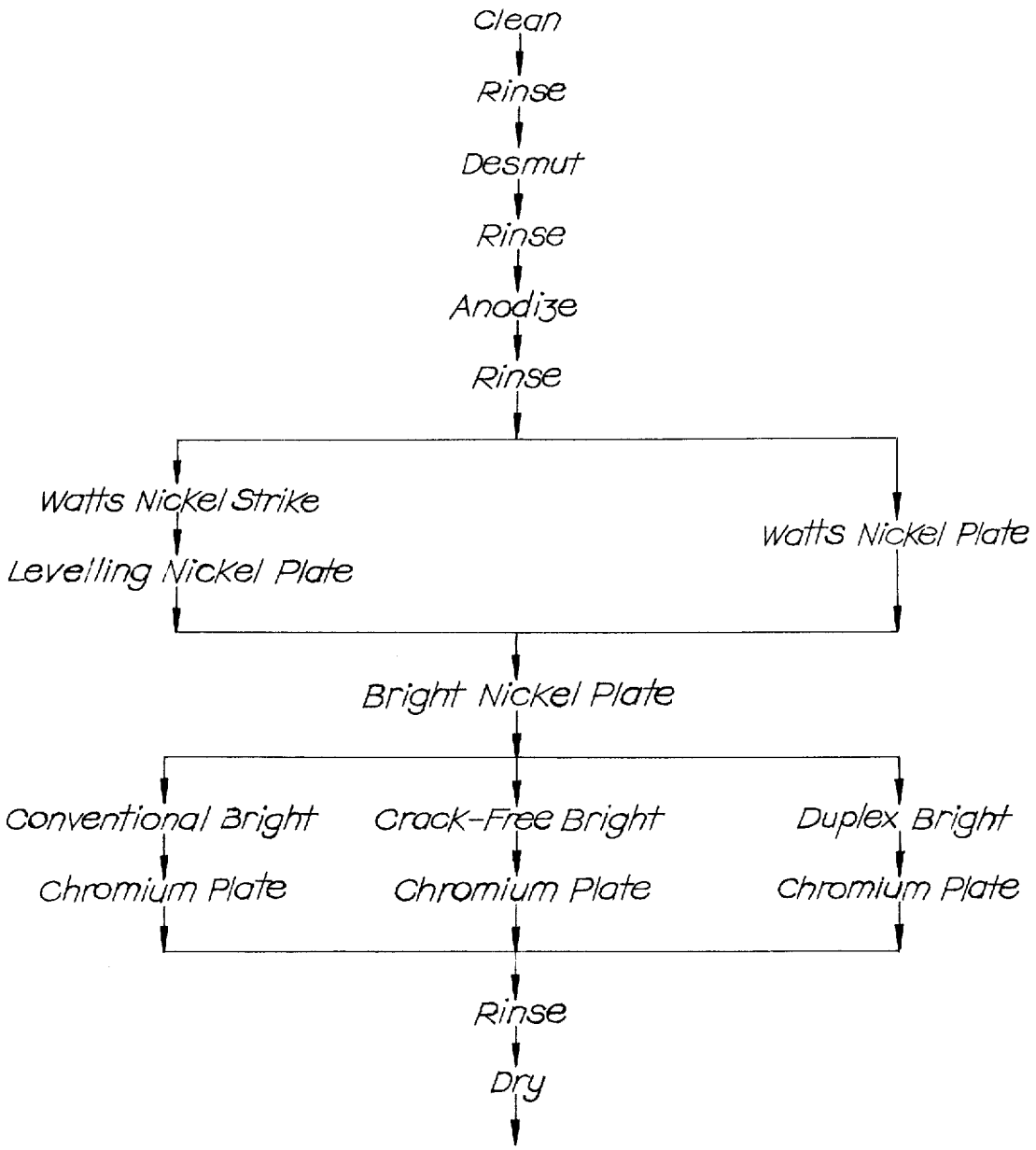
Clean
Rinse
Desmut
Rinse
Anodize
Rinse
Watts Nickel Strike
Levelling Nickel Plate
Watts Nickel Plate
Bright Nickel Plate
Conventional Bright
Chromium Plate
Crack-Free Bright
Chromium Plate
Duplex Bright
Chromium Plate
Rinse
Dry

ANODIZING PRETREATMENT FOR NICKEL PLATING

BACKGROUND OF THE INVENTION

This invention is directed to an improved process of preparing an aluminum workpiece for the subsequent electrolytic application thereon of a nickel coating.

Recently, interest has increased in the utilization of aluminum in automotive applications in exposed areas, such as bumpers and the like, which has required re-evaluation of various methods of applying nickel-chromium coatings onto an aluminum surface. Due to the tenacious natural oxide which forms on aluminum, special preparations are usually required for the aluminum surface prior to electrolytic plating to insure good adhesion between the aluminum substrate and the nickel-chromium coating.

Heretofore, several methods have been employed to prepare an aluminum surface for nickel plating. One method has been first to treat the aluminum surface with a zincate solution and thereby to deposit a thin layer of zinc onto the aluminum and then to electrodeposit a copper containing metal layer onto the zinc coating from an aqueous cyanide solution containing copper. Another method, similar to the first, involves plating a bronze layer directly onto the aluminum surface from an aqueous cyanide solution containing copper and tin. Although the above methods provide excellent adhesion between the aluminum substrate and the subsequent electrodeposited metal layers, they have the rather serious drawback of employing a cyanide solution which is both difficult and expensive to treat for disposal. Moreover, should the plating be penetrated in service, severe galvanic corrosion can occur due to the large potential difference between the copper and the zinc containing interlayer, or between the copper layer and the aluminum substrate.

The third method generally involves anodizing the aluminum workpiece in an aqueous phosphoric acid electrolyte, and then electroplating one or more layers of nickel. The phosphoric acid anodizing pretreatment method poses a significantly less severe disposal problem than the cyanide pretreatment, but this anodizing process is suitable for only certain aluminum alloys and is particularly ineffective in providing good adhesion with aluminum alloys having low levels (e.g., less than 0.30% by weight, particularly less than 0.20% by weight) of insoluble intermetallic particles, such as iron, manganese, chromium and the like. Other acidic electrolytes, such as sulfuric acid and oxalic acid can be employed, but phosphoric acid is preferred because of the improved adhesion and corrosion resistance provided. For an excellent discussion of this pretreatment method, see "Nickel-Chromium Plating Upon Anodized Aluminum; "*Tech. Proc. AES*, 98, 52–9 (1961).

For purposes of appearance and additional protection, the nickel plating is usually followed by the electroplating of a thin layer of chromium. Most conventional chrome plating processes comprise electrolytic treatment in an aqueous chromic acid solution containing a small amount of catalyst, such as a sulfate or a fluoride.

Aluminum alloy 7046 (Aluminum Association alloy designation) is presently a prime candidate for utilization as automotive bumper stock. However, because this alloy has low levels of insoluble intermetallic particles, conventional phosphoric acid anodizing pretreatments will not form a suitable base for an adherent nickel-chromium plate.

Against this background, the present invention was developed.

DESCRIPTION OF THE INVENTION

The present invention relates to an improved pretreatment for aluminum and aluminum alloys prior to the electroplating thereon of nickel. In particular, the process is directed to the anodizing of an aluminum workpiece in an aqueous phosphoric acid electrolyte in a special manner so as to provide an oxide coating having improved adhesion with an electrolytically deposited layer of nickel.

In accordance with the present invention, the electrical parameters of the anodizing process are controlled to provide a rapid increase of voltage so that an operating anodizing voltage is attained within 30 seconds, preferably within 15 seconds, from the start of the electrolytic process. The rapid voltage rise results in a high initial surge of current which subsequently decays to a normal operating level. This method of operation provides an anodic oxide coating to which an adherent nickel plate can be electrolytically deposited and is particularly adaptable to aluminum alloys having low levels of insoluble intermetallic particles, such as 7046 alloy (Aluminum Association alloy designation), which contain less than 0.30% (by weight) usually less than 0.20% (by weight) each of iron, chromium, manganese and the like.

Reference is made to the drawing which illustrates a flowsheet for embodiments of the plating processes contemplated. First, the aluminum workpiece is cleaned in an inhibited alkaline solution, rinsed, desmutted (optional) in an aqueous 50% nitric acid solution, rinsed, then anodized in accordance with the present invention. After anodizing, the workpiece is rinsed, provided with one or more layers of electrodeposited nickel, rinsed again, provided with one or more thin layers of chromium, rinsed again, and dried.

For the invention, the operating anodizing voltage should range from about 45 to 75 volts, and the total anodizing time should be from about 1–10 minutes, preferably about 5 minutes. The anodizing generally need not exceed 60 minutes in duration. Normal operating current density should range from about 15 to about 50 amps/sq ft (1.6–5.4 amps/dm$^2$) with the initial current surge preferably ranging from about 2–5 times the normal operating level. The initial current surge should not exceed 120 amps/sq ft (13.0 amps/dm$^2$), and, preferably, the electrical control package includes a current limiting means to avoid any excessively high current surge which can "burn" the oxide coating.

The phosphoric acid concentration in the electrolyte should range from about 1–50% by weight. Bath temperatures should range from 85° to about 130°F (29.5°–54.5°C), preferably from about 90°–120°F (32.5°–49°C).

A higher acid concentration in the electrolyte can provide better adhesion between the oxide and the nickel plate but also is more apt to cause "burning" of the oxide coating. Although higher acid concentrations can utilize lower current densities, they usually require more stringent control of temperature variation in the bath. Lower acid concentrations in the bath are less susceptible to temperature variation in the bath and allow for greater current densities.

Conventional phosphoric acid anodizing generally provides on a microscopic level a rough scalloped surface due to the degradation of the anodic surface during anodizing by the action of the electrolyte. However, the surface developed by the anodizing process of the present invention remains level and essentially intact, exhibiting normal pore structure throughout the entire oxide layer. This difference is readily apparent upon examination at 20,000X with a scanning electron microscope.

After anodizing, the aluminum workpiece can be directly plated with nickel in a conventional fashion. For example, the workpiece can be plated with nickel in a Watts type bath at a current density of about 15–120 amps/sq ft (1.6–13.0 amps/dm$^2$) at a temperature of about 100°–175°F (38°–79.5°C). Composition of such baths generally includes a large portion of nickel sulfate, a smaller portion of nickel chloride and boric acid. The pH of such solutions can range from 1–7, preferably about 2–5. Many variations on the bath compositions are found in the art and applicable hereto which include replacing all or part of the nickel chloride with ammonium chloride, deleting the nickel chloride entirely or adding nickel chloride in approximately the same amounts as the nickel sulfate. Other suitable electrolytic nickel plating baths include a sulfamate bath which contains large quantities of nickel sulfamate and smaller quantities of nickel chloride and boric acid. One or more various types of nickel plating can be applied to the aluminum workpiece. For example, the aluminum workpiece can be provided with a Watts nickel strike followed by a leveling nickel plate, followed further with a bright nickel plate. However, as described by the present inventor in *Tech. Proc. AES*, supra, in the first few seconds of the first nickel plating operation, the current should be low. If otherwise, the adhesive strength between the nickel and oxide layers will be unacceptably low. When the anodized aluminum is introduced into the nickel strike bath, the oxidized aluminum surface should be thoroughly wet with the bath before any voltage is applied. The voltage should be raised from zero (or if desired, at about 2–5 volts to avoid plating through the "dummying" voltage range) to full operating value in not less than about 5 seconds, preferably in about 10 to 30 seconds. For a description of various types of baths and procedures, see also *Metal Finishing*, Guide Book Directory, 41st Edition (1973).

Following the nickel plating, usually the aluminum workpiece is provided with one or more thin electroplated layers of chromium for purposes of appearance and additional protection. Conventionally, the chromium is electrolytically plated from an aqueous electrolyte containing chromic acid and a catalyst such as sulfate (e.g., sulfuric acid) and fluoride (e.g., fluosilicic acid). Typical chromic acid concentrations range from about 10–100 oz/gal (75–750 gms/liter) with the catalyst to chromic acid weight ratio ranging from about 1:50 to 1:150. For a further description of chrome plating in general, see *Metal Finishing*, supra.

The following examples are given to illustrate the advantages of the present invention, but they are in no way intended to limit the scope of the invention or appended claims. A group of 7046 alloy extrusions 1½ inches (3.8 cm) wide and 6 inches (15.2 cm) long were prepared having the following composition which is given in weight per cent:

| Si | Fe | Cu | Mn | Mg | Cr | Zn | Ti | Zr | Al |
|---|---|---|---|---|---|---|---|---|---|
| 0.06 | 0.10 | 0.14 | 0.18 | 1.4 | 0.10 | 7.4 | .03 | .14 | Bal. |

The extrusion specimens were buffed, first cleaned in an Oakite 61A cleaning solution (60 gm/l, 160°F), rinsed in cold water, cleaned in an Oakite NST cleaning solution (10% by volume, 130°F) for 5 minutes, rinsed in cold water, desmutted in a 50% (by volume) nitric acid solution at room temperature and then rinsed in cold distilled water.

EXAMPLE 1

An extrusion specimen was anodized in a 30% (by weight) phosphoric acid aqueous electrolyte at a temperature of about 100° with an anodizing voltage of about 28 volts and the current density between 61 and 46 amps/sq ft for a period of 5 minutes. The initial anodizing was conducted in a conventional fashion wherein a run-in period of 2–3 minutes was allowed to bring the voltage up to the operating levels. The specimen was then immersed in a sulfamate nickel plating solution sold by M&T Chemicals Corporation having a pH of 4–5 and subjected to electrolysis to form a nickel plate of approximately 1 mil in thickness. The operating plating voltage was reached in about 10 seconds. The nickel plate was then tested in accordance with the procedures set forth in *Plating Magazine*, August 1962, pages 880–881, and it was found to have a peel strength of 2 pounds per lineal inch.

EXAMPLE 2

Another extrusion specimen was anodized in a 30% by weight phosphoric acid electrolyte at a temperature of about 104°F with an anodizing voltage of about 40 volts and the current density between 25 and 77 amps/sq ft for a period of 5 minutes. The initial voltage was applied rapidly to reach the operating voltage within 5 seconds. Subsequently, the specimen was nickel plated in the manner set forth in the previous example. The peel strength of the nickel plate was found to be 28 pounds per lineal inch.

EXAMPLE 3

Another extrusion specimen was anodized in a 20% by weight phosphoric acid electrolyte at a temperature of about 105°F at a voltage of about 45 volts and a current density between 23 and 31 amps/sq ft for a period of about 5 minutes. A run-in period of about 2–3 minutes was used to increase the voltage to operating levels. The specimen was subsequently nickel plated in the manner set forth in the previous examples. The peel strength of the nickel plate was found to be 12 pounds per lineal inch.

EXAMPLE 4

Another extrusion specimen was anodized in a 20% by weight phosphoric acid electrolyte at a temperature of about 107°F at a voltage of about 50 volts with a current density between 23 and 38 amps/sq ft for a period of 5 minutes. The initial voltage was applied rapidly to reach the operating voltage within 5 seconds. The specimen was subsequently nickel plated in the manner set forth in the previous example. The peel strength of the nickel plate was 33 pounds per lineal inch.

From the above examples, it is clear that the method of starting the anodizing procedure in accordance with the present invention provides an outstanding increase in the adhesion between the nickel plate and the aluminum substrate.

It is obvious that various modifications and improvements can be made to the present invention without departing from the spirit thereof and the scope of the appended claims.

What is claimed is:

1. In the electrolytic plating of nickel onto an aluminum substrate having low levels of insoluble intermetallic particles wherein the aluminum substrate is first anodized in an acidic aqueous electrolyte containing only phosphoric acid as the acid species and then a layer of nickel is electrolytically plated onto the anodized substrate from an acidic aqueous solution containing at least one nickel compound, the improvement comprising controlling the anodizing procedure so that a predetermined voltage in the range between about 45 and 75 volts is reached within 30 seconds from the start of the anodizing procedure, causing a high initial current density not exceeding 120 amps/ft$^2$ which decays to a level between 15 and 50 amps/ft$^2$.

2. The method of claim 1 wherein the predetermined voltage is reached within 15 seconds from the start of anodizing.

3. The method of claim 1 wherein the high initial current density during said 30-second interval exceeds the level to which the current density decays by a factor of at least 2.

4. The method of claim 1 wherein the anodizing electrolyte contains from about 1–50% by weight phosphoric acid.

5. The method of claim 1 wherein the temperature of the anodizing bath ranges from about 85°–130°F.

6. The method of claim 1 wherein the nickel compound is selected from the group consisting of nickel sulfate, nickel chloride, nickel sulfamate and nickel phosphate.

7. The method of claim 1 wherein the aluminum substrate is an aluminum alloy containing less than 0.30% by weight each of elements which exist as essentially insoluble intermetallic particles.

8. The method of claim 7 wherein the aluminum substrate is a 7046 aluminum alloy.

* * * * *